United States Patent [19]

Lau et al.

[11] Patent Number: 4,830,271

[45] Date of Patent: May 16, 1989

[54] END CLOSURE FOR A MULTI-WALLED CONTAINER

[75] Inventors: Kenneth K. Lau, Vancouver; David F. Gillard, Surrey, both of Canada

[73] Assignee: MacMillan Bloedel Limited

[21] Appl. No.: 250,987

[22] Filed: Sep. 28, 1988

Related U.S. Application Data

[63] Continuation of Ser. No. 122,930, Nov. 19, 1987, abandoned.

[51] Int. Cl.[4] ..... B65D 5/36

[52] U.S. Cl. ..... 229/117; 229/23 R; 229/41 R; 229/125.19; 229/125.33

[58] Field of Search ..... 229/41 R, 41 B, 125, 229/19, 125, 33, 117, 23 R, 23 BT

[56] References Cited

U.S. PATENT DOCUMENTS

| | | | |
|---|---|---|---|
| 1,119,208 | 12/1914 | Weiss | 229/125.19 |
| 1,156,250 | 10/1915 | Scott | 229/41 R |
| 1,430,149 | 9/1922 | Bliss | 229/125.19 |
| 1,700,733 | 2/1929 | Berkowitz | 229/41 B |
| 2,567,786 | 9/1951 | Rosenberg | 229/23 R |
| 2,658,664 | 11/1953 | Hennessey | 229/125.19 |
| 2,766,923 | 10/1956 | D'Esposito | 229/125.19 |
| 2,880,866 | 4/1959 | Van Dyck | 229/125.19 |
| 4,441,948 | 4/1984 | Gillard et al. . | |
| 4,601,407 | 7/1986 | Gillard . | |
| 4,623,072 | 11/1986 | Lorenz . | |

FOREIGN PATENT DOCUMENTS

| | | | |
|---|---|---|---|
| 550162 | 12/1951 | Canada . | |
| 576276 | 5/1959 | Canada . | |
| 690591 | 7/1964 | Canada | 229/125.19 |
| 690695 | 7/1964 | Canada . | |
| 24581 | 10/1896 | United Kingdom | 229/41 R |

OTHER PUBLICATIONS

Packaging Materials, School of Packaging, pp. 31-33 (1977).

*Primary Examiner*—Stephen Marcus
*Assistant Examiner*—Gary E. Elkins

[57] ABSTRACT

A multiwalled container made of corrugated paper board and formed from an open ended sleeve of such multiwalled container board is provided with an end closure that is discreet from the sleeve but is connected thereto via flaps connected to the outer surface of the walls of the sleeve. The closure includes at least one panel connected to the sleeve by the flaps and providing a bridging member extending across the open end of the sleeve and functioning to resist outward deflection of the side walls of the sleeve via tension in the bridging member when said container is erected and foldable into the interior of said sleeve when said container is in knock down condition.

5 Claims, 5 Drawing Sheets

END CLOSURE FOR A MULTI-WALLED CONTAINER

This application is a continuing application of application Ser. No. 122,930 filed Nov. 19, 1987 now abandoned.

FIELD OF THE INVENTION

The present invention relates to multiwall container particularly for bulk material formed by a multiwalled open ended sleeve provided with a discrete closure member that resists bulging of the sleeve wall via tension in the closure member.

BACKGROUND OF THE PRESENT INVENTION

The bulk containers made of multiwalled corrugated material laminated together are well known. Similarly, closure members for such containers are also well known. Normally such closure members comprise flaps internally foldably connected to the ends of the sleeve. The flaps are intended to be folded inwardly to close the open ends of the container (sleeve). Such flaps are normally made of the same material, i.e. the multilayered material of the side walls of the sleeve and are simply extensions of the walls separated from the walls by a fold line. Thus these closures while providing a structure that may be knocked down for shipment to the customer do require a significant amount of material particularly assuming they are to close completely the open end of the sleeve. When these flaps are folded into position perpendicular to their respective side walls they inhibit deflection of the side walls by an internal load and thus have the added function of strengthening the container to resist bulging of the side walls.

It is also known to manufacture a multiwall container in the form of an open ended sleeve and to slit the sleeve adjacent its opposite ends along the fold lines connecting the adjacent wall panels to provide reinforcing rim flaps that are then folded over into face to face relationship with the outside wall panels of the container to provide a reinforcing rim encircling the periphery of the open end of the sleeve. This rim may be further reinforced by a banding member extending there around to further aid in reduction of bulging. Obviously the structure per se does not provide for very significant resistance to bulging of the side walls.

It is also known to put a capping panel over the top of the open ended sleeve having reinforcing rims as above described and to interlock flaps on the capping panel with the flaps extending from the side wall and forming the reinforcing rim so that each cap is connected by flaps to the reinforcing rim at least on one pair of opposite sides of the sleeve. Normally this structure is then held together by a suitable band extending around the rim and holding the flaps on the top panel or cap to the container or sleeve, see Canadian Pat. Nos. 576,276 issued May 19, 1959 to Welshenbach or 690,695 issued July 14, 1964 to Gile.

It will be apparent that the latter structure requires the provision of many discrete parts, i.e. a sleeve, caps, and bands to the party filling the container and party filling the container must assemble the various flaps, caps and banding material to close the container. Normally customers buying such containers do not want to be involved in maintaining an inventory of and assembling parts anymore than is absolutely essential.

Recently, multiwalled wound containers made primarily by winding multiple layers of corrugated material have been taught in U.S. Pat. No. 4,441,948 issued Apr. 10, 1984 to Gillard et al. and further refined as described in U.S. Pat. No. 4,601,407 issued July 22, 1986 to Gillard to permit folding into a substantially flattened knocked down sleeve for easy shipment.

This container has been further modified as taught in U.S. Pat. No. 4,623,072 issued Nov. 18, 1986 to Lorenz to be provided with flaps for reinforcing the end of the container when closing same. These flaps, using the particular fold line disclosed, fold into nestled relationship on the inside of the sleeve and provide an angle structure extending around the circumference of the sleeve reinforcing the walls of the sleeve to inhibit bowing under internal load.

Canadian Pat. No. 550,162 issued Dec. 17, 1957 to Dedmon (U.S. Pat. No. 2,778,523) discloses a wooden crate (wire bound) having closed flaps secured thereto adjacent the top and bottom so that the flaps may be folded over to close the end of the crate to replace the wooden panel that was normally nailed in place.

BRIEF DESCRIPTION OF THE PRESENT INVENTION

It is an object of the present invention to provide an end closure adapted to reinforce an open ended sleeve formed of multilayered corrugated board to inhibit bulging of the side walls of the sleeve by filling.

Bodily the present invention comprises a multiwalled knocked down container of corrugated paperboard comprising an open ended sleeve of multilayered corrugated paperboard and having at least four side walls integral foldably interconnected, a discrete end closure mean for closing at least one open end of said sleeve, said closure means including an end closure panel and flap foldably connected to one side of said closure panel, said panel and flap being significantly weaker than said sleeve, means connecting said flap to an outside surface of one of said walls of said sleeve adjacent said one open end, said closure extending substantially from one side of said sleeve to an opposite side of said sleeve, means connecting said panel to the outside of another wall of said sleeve adjacent said one open end, said panel providing at least a portion of a bridge extending across said one open end of said sleeve between said one and said another walls so that forces tending to deflect said one and said another walls of said sleeve outward are resisted by tension in said panel.

In one embodiment of the invention a second flap is foldably connected to another side edge of said panel. In the preferred embodiment of said invention said panel is triangular and said first and second flap are foldably connected to adjacent side edges of said panel and said one and another walls of said sleeve will be adjacent foldably interconnected walls of said sleeve.

In yet another embodiment of the present invention said panel will be rectangular and will have flaps foldably connected to at least one pair of opposite side edges of said panel.

Preferably said triangular panel will be foldably connected to said flaps by an intermediate connecting panels connected to said closure panel by a first fold line and to said flap by a second fold line parallel to and spaced from said first fold line by a distance substantially equal to the thickness of said walls of said sleeve.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
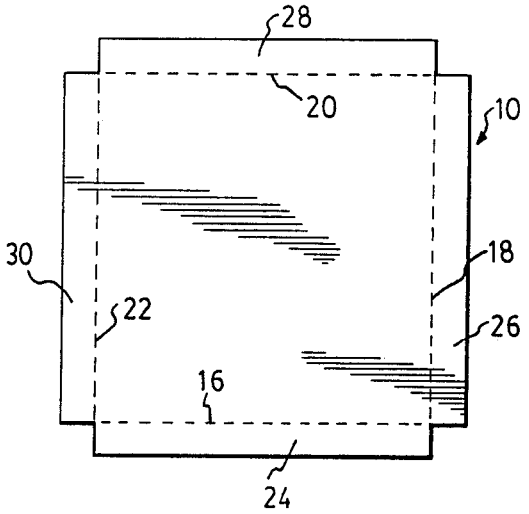
FIG. 1 is a plan view of a simplified cap closure for closing an open end of a sleeve type container.
Figure 2:
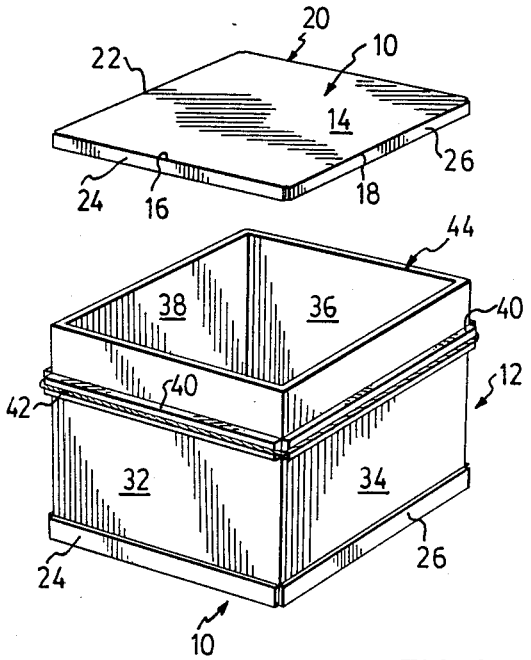
FIG. 2 is an isometric schematic illustration of the bulk container ready to be filled and with the top cap in position to close the top end of the sleeve.

A relatively simple end closure or cap 10 is illustrated in FIG. 1. This cap 10 is adapted to be applied to a sleeve of substantially rectangular construction as illustrated at 12 (FIG. 2). The top closure member or cap 10 is formed by a main rectangular panel 14 having connecting flaps 24, 26, 28 and 30 foldably connected thereto by fold lines 16, 18, 20 and 22, respectively. The fold lines 16 and 20 are at one pair opposite ends of the panel 14 are substantially parallel while the fold lines 18 and 22 are on the other pair of opposite ends of the panel 14 and are substantially parallel and substantially perpendicular to lines 16 and 20 and define the rectangular periphery of the panel 14. It will be apparent that if the sleeve 12 is not rectangular in section the shape of the panel 14 will be modified accordingly to substantially match the cross section of the sleeve 12.

The sleeve 12 is formed from a plurality of layers of corrugated material and has an outer periphery dimensioned substantially the same as the panel 14. The periphery of the sleeve is defined by the ends of the sleeve walls 32, 34 and 36 and 38 which are foldably interconnected along their adjacent edges to combine and define rectangular sleeve 12. While the sleeve is shown as rectangular in cross section in all the drawings, it will be clear that sleeve may have other suitable cross sectional shapes if desired.

Preferably the sleeve 12 will be formed by winding on a mandrel taught in said U.S. Pat. Nos. 4,441,948 and 4,601,407.

In cap 10 is folded along the fold lines 16, 18, 20 and 22 to position the flaps 24, 26, 28 and 30 substantially perpendicular to the panel 14 as shown in FIG. 2. A bottom cap 10 is so folded and preapplied to the bottom of sleeve 12 and then the sleeve 12 with a bottom formed by a bottom cap 10 (as shown in FIG. 2) may be filled with the desired amount of material. After filling the top cap 10 is positioned above the sleeve 12 as shown in FIG. 2 and is moved down so that the flap 24 may be secured to the wall 32, flap 26 to wall 34, flap 28 to wall 36 and flap 30 to wall 38. These flaps are all connected to the outer surfaces of their respective sleeve walls for example by adhesive between the flaps and their respective wall. It is important that the dimension of the panel 14 be coordinated with those of the sleeve 12 in unloaded condition so that any tendency for buldging of the walls of the sleeve 12 is transmitted to and resisted by tensing in panel 14.

It will be apparent that any tendency for the walls 32 and 36 to move apart is resisted by tension across the panel 14 between the two flaps 24 and 28 and similarly any tendency for the walls 34 and 38 to move apart is resisted by tension in the panel 14 between the flaps 26 and 30. These two tension forces being mutually perpendicular for the rectangular cross section sleeve 12 illustrated.

In FIG. 2 a suitable jig composed of wooden or the like slats 40 wrapped by a releasable band 42 is applied around the periphery of the sleeve 12 to prevent deformation of the walls of the sleeve 12 during filling and until the cap 10 is secured to the sleeve 12 and bridges the open end 44 of the sleeve.

In the FIG. 2 arrangement the same type of end closure is applied to both top and bottom of the sleeve 12, difluent closures may be used at each end, however it is important that the closure form a structural part of the closed container to resist bowing of the sleeve walls.

Figure 3:
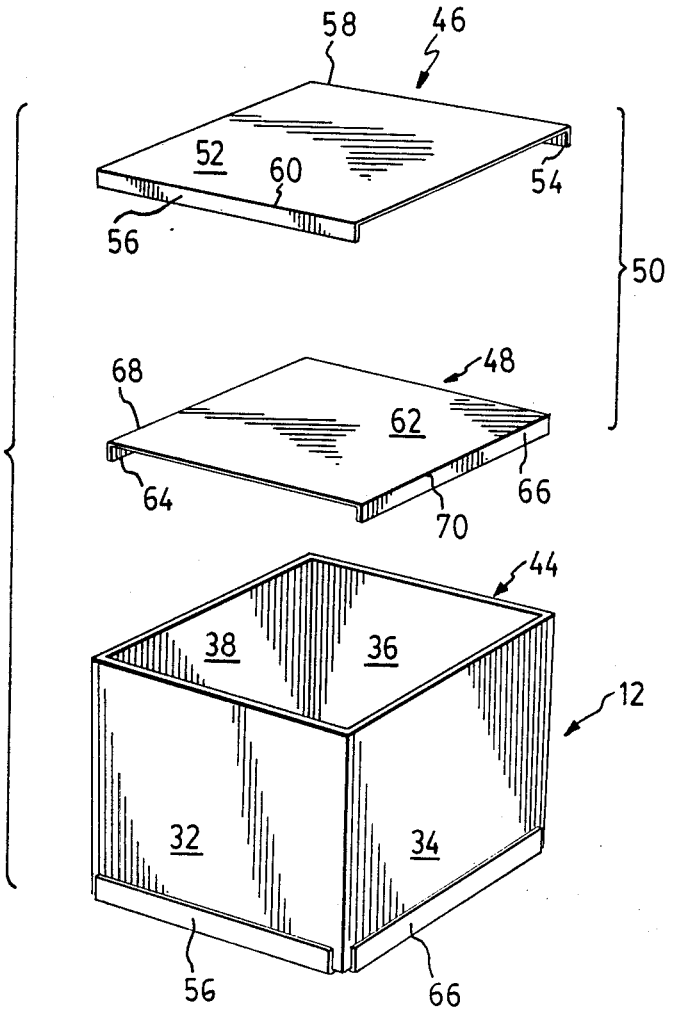
FIG. 3 is a view similar to FIG. 2 showing a modified form of cap structure.

In FIG. 3 a pair of mutually transverse members 46 and 48 combine to form a cap 50. Member 46 is formed by a central panel 52 having pair flaps 54 and 56 connected one to each of a pair of opposite sides of the panel 52 by fold lines 58 and 60 respectively.

The member 48 is similar to the member 46 and is formed by a central panel 62 having a pair of flaps 64 and 66 connected one to each of a pair of opposite ends of the panel 62 by fold lines 68 and 70 respectively.

In the system illustrated in FIG. 3 the member 48 is first applied to the sleeve 12 by securing the flaps 64 and 66 to the outside of a pair of opposed end walls 38 and 34 respectively. The length of the panel 62 between the fold lines 68 and 70 is equal to the distance between the outside of the side walls 34 and 38 of the sleeve 12 so that when the flaps 64 and 66 are secured to the outside of the walls 38 and 34 the panel 62 extends tightly across the open end 44 of the sleeve 12 and resists through tension any tendency for bulging of the walls 34 and 38 away from each other.

Member 46 is then moved into overlying relationship with the member 48 and the flap 56 and 54 are secured to the outer faces of the walls 32 and 36. The distance between the fold lines 58 and 60 is substantially equal to the distance between the outer surfaces of the walls 32 and 36 so that when the member 46 is secured to the walls 32 and 36 any tendency for these walls 32 and 36 to move apart is resisted by tension in the panel 52.

It will be apparent that the embodiment shown in FIGS. 1, 2, and 3 inclusive only one flap of the cap 14 and one flap of each of the members 46 and 48 may be preapplied to the sleeve 12 by the box manufacturer, if sleeve 12 is to be shipped in knocked down condition, with the end closures attached i.e. with the walls 32 and 38 in face to face relationship and the walls 34 and 36 in face to face relationship for example.

It will be noted that the cap or end closure 10 is separate and discrete from the sleeve 12 and therefore may be made, for example from a single layer of corrugated board, i.e. a pair of liners with a corrugated medium there between or even by a single sheet of heavy paper since the forces involved are tensile forces and paper is relatively strong in tension. This results in a significant saving in material.

It is also apparent that the paper is stronger in the machine direction than the cross machine direction. Hence, if paper per se is to be used as the top closure in arrangement such as that shown in FIG. 3 the machine direction of the paper preferably extends between the fold lines 58 and 60 for the element 46 and between the fold lines 68 and 70 and the elements 48 to apply the tension in these members in the machine direction (in many cases this will not be essential).

In the embodiment shown in FIG. 3 the panels 52 and 62 may be secured together for example by a layer of adhesive therebetween to further reinforce the top closure.

If desired adhesive such as a layer of pressure sensitive adhesive may be preapplied to the flaps 24, 26, 54, 56, 64 and 66 to facilitate closure, or contact adhesive may be preapplied to the flaps and the cooperating portions of the outside surfaces of the sleeve. When adhesive is preapplied it must be protected until used to prevent premature sticking of the adhesive, for example by release strips overlying the adhesive.

Figure 4:
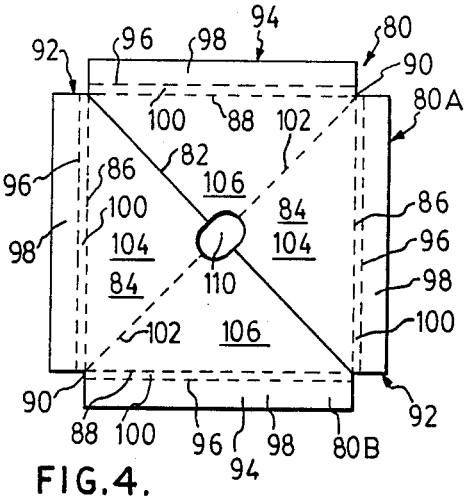
FIG. 4 is a plan view of a preferred embodiment of the invention showing a blank for forming top cap structure that may be preapplied to the sleeve for shipment to a customer and that automatically moves to closed position when the sleeve is erected or squared.

FIG. 4 is a plan view a blank for an end closure 80 for a sleeve 12. In this case the end closure is formed in two parts and may be preapplied to the sleeve to form a container that may be shipped to the customer in knocked down conditions and that is automatically closed when the sleeve with the closure attached is erected or squared.

As shown the blank for the end closure 80 is divided into two parts 80A and 80B by a line of severance 82. Each part is composed of a main triangular panel 84 defined on one side by a free edge formed by the line of severance 82 and on the other sides by fold lines 86 and 88 which for closure for a rectangular sleeve meet at a right angle at a corner 90. Connected to the main triangular panel 84 via the fold line 86 and 88 are connecting flaps 92 and 94 each of which is divided by a second fold line 96 substantially parallel to its connecting fold line 86 or 88, into a glue flap 98 and a connecting panel 100. The spacing between fold lines 96 and 86 or 96 and 88 (width of panels 100) corresponds with the thickness of the sleeve walls.

A fold line 102 extends from the intersection 90 of the two fold lines 86 and 88 in a direction bisecting the angle between the fold lines 86 and 88 and divides the panel 84 into a pair of smaller triangular panels 104 and 106.

Figure 5:
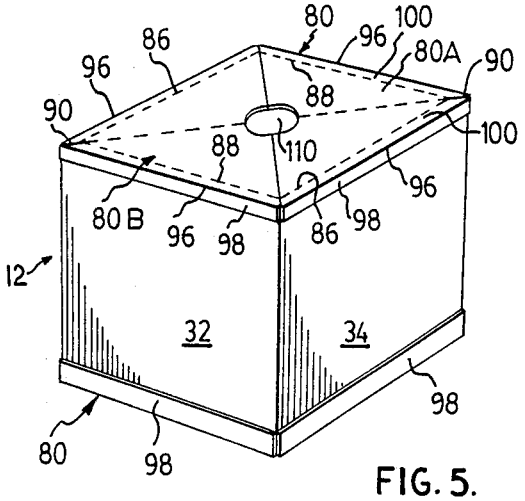
FIG. 5 is a view of a sleeve closed by the top closure cap illustrated in FIG. 4.
Figure 6:
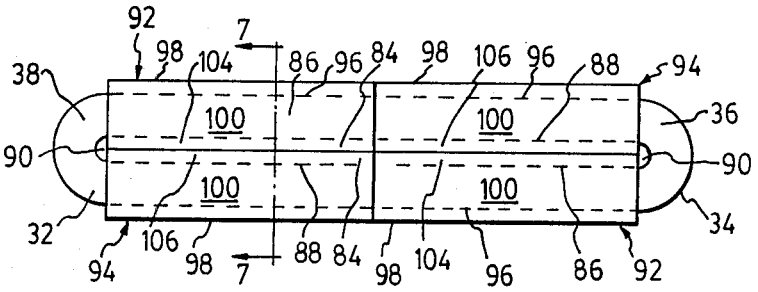
FIG. 6 shows an end view (top or bottom) of a knocked down container having an end closure of the type illustrated in FIG. 4 attached thereto.

The two parts 80A and 80B combine to form the closure 80 each may be preconnected to the sleeve 12 by a erecting the sleeve 12 as shown in FIG. 5 and securing each of the flaps 98 to the outside of its adjacent of the walls 32, 34, 36 and 38 of the sleeve 12 adjacent the open ends thereof.

Figure 7:
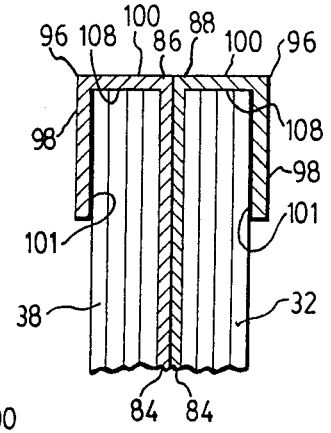
FIG. 7 is a view along the line 7—7 of FIG. 6.

The fold line 96 on each of the flaps 92 and 94 overlies the outer edge of the walls 32, 34, 36 and 38 to which the flap is connected (see FIG. 7), while the connecting panels 100 each overlie the top edge 108 of the respective walls 32, 34, 36 and 38 to which its adjacent flap 98 is secured (FIG. 7). Thus the spacing between the fold lines 86 and 96 (width of connecting panels 100) is correlated with the thickness of the side walls of sleeve 12 so that when the container is in knocked down condition the flaps 98 are in face to face relationship with and secured to the outsides of the walls of the sleeve 12 and the panels 84 are in face to face relationship with the inside of the walls of the sleeve 12 and the panels 100 extend across the thickness of the sleeve walls.

After the top cap and/or bottom cap have been secured to the side wall of the sleeve 12, for example by a band of adhesive 101 (see FIG. 7), the sleeve may then be knocked down by collapsing the corners of the sleeve coinciding with the corners 90, i.e. in the illustrated arrangement the corner between the walls 38 and 32 is collapsed as is the corner between the walls 34 and 36 so that the main triangular panels 84 of each of the closures is folded along the fold line 102 to move the triangular panel 104 and 106 into face to face relationship with inside faces of their respective adjacent side walls of the sleeve 12 and form a knocked down container with the end closures preattached thereto.

In the arrangement illustrated in FIG. 4 to 7 inclusive the end closures 80 is provided with an aperture formed by cuts extending from the free edge 82 cut into the panels 84 as indicated at 110 to permit access into the interior of the carton formed from the sleeve 12 and end closures 80. It will be apparent that when the sleeve is erected the end closures 80 will tend to close off both ends of the formed container if the same end closure structure is applied to both ends of the sleeve.

The apertures 110 provide an opening into which a filler spout for example may be inserted to communicate with a bag (not shown) positioned within and adapted to form a liner for the container.

Figure 8:
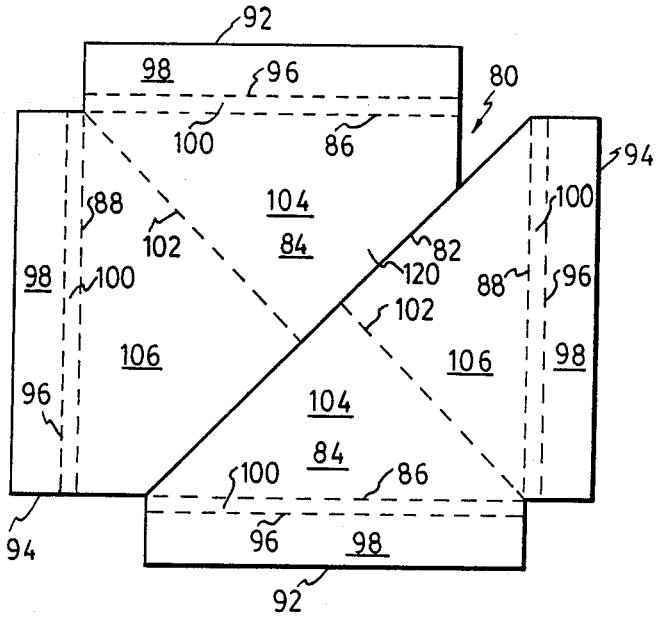
FIG. 8 is a plan view of a top closure similar to that shown in FIG. 4 but further incorporating an extension flap.
Figure 9:
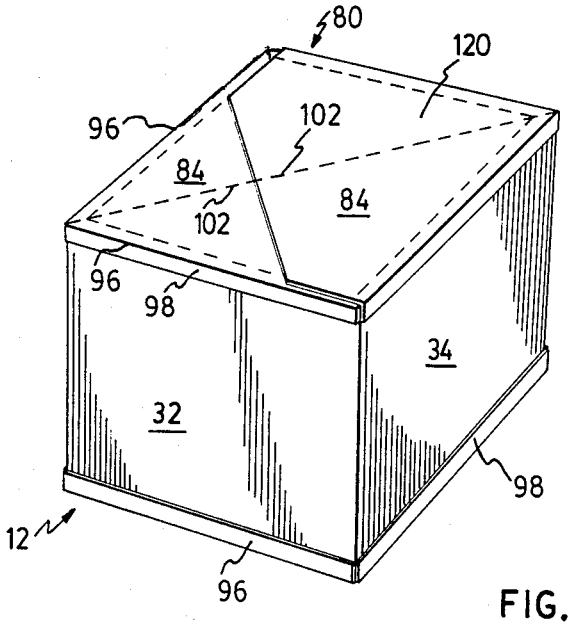
FIG. 9 is a view similar to FIG. 5 showing the erected container having the end closure illustrated in FIG. 8.

The embodiment shown in FIG. 9 is very similar to that shown in FIGS. 4 to 7 inclusive the only difference being that one of the main triangular panels 84 has been extended via a trapazoidal extension 120 that is adapted to overlap the adjacent area of the triangular panel 84 of the cooperating end closure member either above or below same as illustrated in FIG. 9. It will be noted that the fold line 102 across the panel 84 with extension 120 extends right across the extension 120. The remainder of the closure illustrated in FIG. 8 is essentially the same as that shown in FIG. 4 and like parts have been indicated by like references numerals.

Strongly securing the extension 120 to the underlying (or underlying) panel of the cooperating end closure significantly strengthens the erected container. This may be accomplished for example by suitable adhesive or mechanical connections (not shown).

It will be apparent that if desired a similar extension 120 could be formed on both the cooperating panels 84 and that the extensions on the different panels need not be the same.

Figure 10:
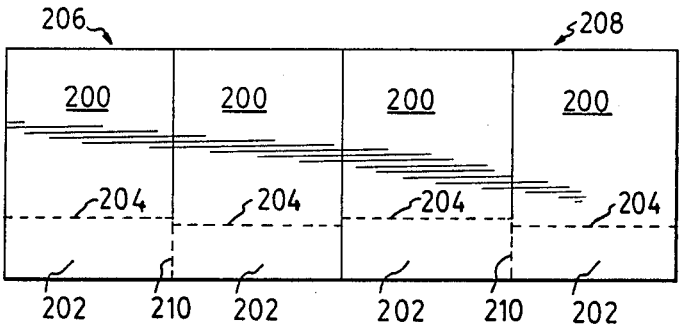
FIG. 10 is a plan view of a further blank suitable of preapplication to a sleeve and adapted to form a conventional flap end closure for the sleeve.
Figure 11:
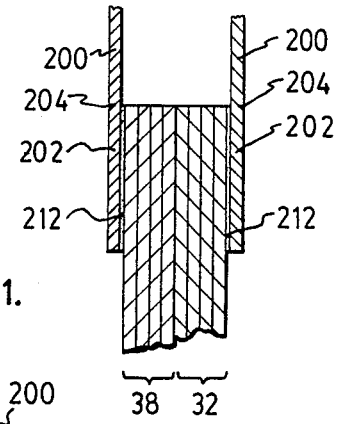
FIG. 11 is a view similar to FIG. 7 illustrating the closure of FIG. 10 attached to a knocked down sleeve.
Figure 12:
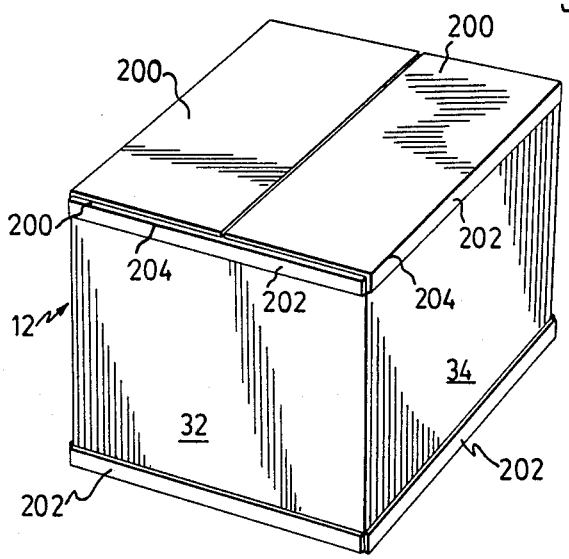
FIG. 12 is a view similar to FIGS. 5 and 9 but illustrating the end closure structure of FIG. 10.

FIGS. 10, 11 and 12 illustrate a further embodiment of the present invention wherein discrete closure flaps 200 substantially equivalent to conventional closure flaps as used on corrugated boxes are connected to connecting panels 202 via a fold line 204. In the arrangement illustrated the four flaps 200 are formed by a pair blanks 206 and 208 each containing a pair of flaps 200 with their respective fold lines 204 and connecting panels 202. The two connecting panels 202 for a single blank 206 or 208 are connected via a fold line 210 substantially perpendicular to the fold lines 204. Each pair of fold lines 204 in their respective blanks 206 or 208 may be offset from one another to accommodate the thickness of the material from which the blank 206 or 208 is made so that one of the flaps 200 from each of the blanks 206 and 208 can be folded underneath the other as shown in Figure 12.

The blanks 206 and 208 may be applied to a knockdown container by securing the panels 202 to the outside of the walls of the container such as the walls 32 and 38 illustrated in FIG. 11 by a strip of adhesive 212.

A sleeve 12 with flaps such as those shown in FIG. 10 adhere to the outer ends thereof can be closed in any conventional manner as used with conventional corrugated boxes having integral flaps foldably connected to the side walls but obviously must be securely interconnected to obtain the bridging effect to reinforce the sleeve.

It will be noted that the flaps such as the flaps 200 are of significantly less thickness (weaker) than the side walls 32 or 38 as were the top closures 80, 10 and 50 thereby permitting significant saving of material while retaining adequate strength.

The use of discrete end closure separate from the sleeve and secured to the sleeve is particularly important if a wound container (sleeve) is to be used such as taught in U.S. Pat. No. 4,441,948 and the present invention is particularly related to such a container as the mandrel then need only used only from the sleeve and not the closure.

Having described the invention modifications will be evident to those skilled in the art without departing from the spirit of the invention as defined in the attendant claims.

We claim:

1. A multi-walled container formed from an open ended sleeve having a substantially rectangular cross section and formed by side walls interconnected by corner forming fold lines and made from a plurality of layers of corrugated board, end closure means for closing at least one open end of said sleeve, a said end closure means including a main substantially triangular end panel having a first and a second connecting flap means foldably connected to a pair of adjacent shorter side edges of said main triangular end panel by a first and a second fold line respectively, third and fourth fold lines substantially parallel to said first and second fold lines respectively and dividing said first and said second connecting flap means respectively each into a connecting panel and a securing flap, said connecting panel in said first connecting flap means being positioned between said first and third fold lines and said connecting panel in said second connecting flap being means between said second and fourth fold lines, the distances between said first and third and between said second and fourth fold lines being substantially equal to the thickness of said walls of said sleeve, a diagonal fold line dividing said triangular panel into a pair of symmetrical smaller triangular panels, said diagonal fold line extending between a longest edge of said main triangular panel and an intersection of said pair of shorter side edges of said main triangular panel, means securing said flap of said first flap means into face to face relationship with an outside surface of one wall of a first pair of adjacent side walls of said sleeve and means securing said flap of a said second securing flap means into face to face relationship with an outside surface of another wall of said first pair of adjacent side walls of said sleeve, and wherein each of said third and fourth fold lines is positioned adjacent the intersection of the outer surface of the side wall to which its adjacent flap is secured and an adjacent end edge of said sleeve, said end closure means being dimensioned to correspond with the cross section of said sleeve whereby any tendency for said walls of said sleeve to be deflected outward is immediately transmitted to said main triangular panel and said main triangular panel forms at least a portion of a bridge extending across said one open end of said sleeve and deflection of said first pair of side walls of said sleeve outwardly is resisted by tension in said main triangular panel.

2. A container as defined in claim 1 wherein said closure means further includes a second main triangular panel substantially the same as said main triangular panel but having its flaps connected to a second pair of adjacent side walls of said sleeve different from said said walls of said first pair of sidewalls, said second main triangular panel resisting deflection of said side walls of said second pair of side walls.

3. A container as defined in claim 2 wherein said second main triangular panel has an extension extending from a longest edge thereof said extension being adapted to overlap an adjacent portion of said main triangular panel.

4. A container as defined in claim 2 wherein the length of the shorter sides of each of said main triangular panels is substantially equal to the length measured in the direction substantially perpendicular to said corner forming fold lines defining the side wall to which its respective flap of said connecting flap means is secured.

5. A container as defined in claim 3 wherein said smaller triangle panels lie in face to face relationship with an adjacent inner surface of said walls of said sleeve and said connecting panels lie in face to face relationship with an end edge of the wall to which its respective flap is connected.

* * * * *